US006223366B1

(12) United States Patent
Cheng

(10) Patent No.: US 6,223,366 B1
(45) Date of Patent: May 1, 2001

(54) FOLDABLE MECHANISM FOR PLAYPEN

(75) Inventor: Kenny Cheng, No. 16, Lane 47, Chih Feng St., Taipei (TW)

(73) Assignee: Kenny Cheng, Taipei (TW)

( * ) Notice: Subject to any disclaimer, the term of this patent is extended or adjusted under 35 U.S.C. 154(b) by 0 days.

(21) Appl. No.: 09/437,654

(22) Filed: Nov. 10, 1999

(51) Int. Cl.[7] ..... A47D 7/00

(52) U.S. Cl. ..... 5/99.1; 403/102; 403/324; 16/326

(58) Field of Search ..... 16/326; 403/102, 403/324; 5/98.1, 99.1

(56) References Cited

U.S. PATENT DOCUMENTS

| | | | | |
|---|---|---|---|---|
| 5,293,656 | * | 3/1994 | Chan | 5/98.1 X |
| 5,730,542 | * | 3/1998 | Cheng | 403/102 |
| 5,803,650 | * | 9/1998 | Wu | 5/99.1 X |
| 5,906,014 | * | 5/1999 | Zhuang | 5/99.1 |
| 5,978,987 | * | 11/1999 | Wang | 5/99.1 |
| 6,082,922 | * | 7/2000 | Cheng | 5/99.1 X |

* cited by examiner

*Primary Examiner*—Michael F. Trettel
(74) *Attorney, Agent, or Firm*—Woodcock Washburn Kurtz Mackiewicz & Norris LLP

(57) ABSTRACT

A foldable mechanism for a playpen includes a connection element having substantially an U-shaped cross section with two open side faces, one front face, and one rear face, the front and rear faces being provided with a U-shaped cutout and a plurality of first openings and a plurality of second openings; a press-down block having two sides each with a side groove having a narrow portion and a enlarged open end, front and rear faces each having a groove with two closed ends, an elongated through hole passing through the front and rear faces, and a hollow center with one closed end for receiving a spring, the press-down block being attached to the connection element by a first screw passing through the through hole and pressed against the spring, such that the press-down block can be pressed down, or biased, with respect to the connection element by an external force and moved back by the spring force; and a pair of hollow rods each having therein a U-shaped reed spring with protrusions on both outer faces of the reed spring, each rod being attached by a second screw to the connection element.

3 Claims, 8 Drawing Sheets

FOLDABLE MECHANISM FOR PLAYPEN

BACKGROUND OF THE INVENTION

1. Field of the Invention

This invention relates to a foldable mechanism, and more specifically, to a foldable mechanism for a playpen.

2. Description of Prior Arts

A wide variety of playpens, have been designed, developed, and commercialized for many years. One of these designs is that the playpen may be folded for storage.

A well known foldable playpen, as shown in FIG. 1, uses a foldable structure 1, comprising a coupling element 2 having a substantially U-shaped cross section; a pair of hollow rods 3 each having therein an engaging element 4 which may extend or retract with respect to the rods through a spring 5, and pivotally screwed to the coupling element 2 by a screw 6; a fixed block 7 secured in the coupling element 2, having a cutout 8 for engaging with the engaging element 4; and a press-down element 9 positioned below and slidably connected to the fixed block 7 for disengaging the engagement between the engaging element 4 and the fixed block 7 when the press-down element 9 is pressed down, or biased, with respect to the fixed block 7 by an external force. When the playpen is in an unfolded condition, the rods 3 are in a horizontal orientation with the engaging element 4 being engaged with the cutout 8 of the fixed block 7. When the playpen is in a folded condition, the press-down element 9 is pressed to disengage the engaging element 4 from the fixed block 7, such that the rods 3 may pivot to a vertical orientation.

In the prior art stated above, the foldable structure uses many parts, which not only complicate the structure but also increase the cost thereof.

Further, in the prior art, most of the parts, such as the fixed block, the press-down element, and the engaging elements, are made of, for example, plastic, which will further increase the manufacturing cost.

Therefore, a foldable playpen that uses few parts and is less expensive to manufacture would be very desirable.

SUMMARY OF THE INVENTION

According to an aspect of the invention, a simple foldable mechanism reduces the number of parts required.

According to another aspect of the invention, a foldable mechanism, where only one part is made of, for example, plastic, so as to further reduce the manufacturing cost.

The foldable mechanism for a playpen comprises a connection element having substantially an U-shaped cross section with two open side faces, one front face, and one rear face. The front and rear faces include a U-shaped cutout and a plurality of first openings and a plurality of second openings. A press-down block includes two sides each with a side groove having a narrow portion and an enlarged open end, front and rear faces each having a groove with two closed ends, an elongated through hole passing through the front and rear faces, and a hollow center with one closed end for receiving a spring. The press-down block is attached to the connection element by a first screw passing through the through hole and pressed against the spring, such that the press-down block can be pressed down, or biased, with respect to the connection element by an external force and moved back by the spring force. A pair of hollow rods each include therein a U-shaped reed spring with a protrusion on each outer face of the reed spring. Each rod is attached by a second screw to the connection element. In the unfolded condition, each hollow rod is pivotally rotated, the duck bill of the reed spring is slid along the narrow portion of the side groove of the connection block and the reed spring is expanded and the protrusions are engaged into the second openings provided on the front and rear faces of the connection element after the duck bill of the reed spring enters into the enlarged open end of the side groove. In the folded condition, the connection element is pressed down, or biased, so that the duck bill of the reed spring is pressed to exit the enlarged open end and enters into the narrow portion of the side groove, the reed spring is pressed, the protrusions are disengaged from the openings, and the rods may pivotally rotate to vertical orientation.

Preferably, the foldable mechanism further comprises a pair of screws passing through openings provided on the front and rear faces of the connection element so as to limit the rotation of the hollow rods.

Preferably, the press-down block further comprises protrusions extending from the two sides of the press-down block for positioning the press-down block in the cutout of the connection element without rotation.

Additional features of the invention will be described hereinafter which form the subject of the claims of the invention. It should be appreciated by those skilled in the art that the conception and the disclosed specific embodiment may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a further understanding of the nature and objects of the invention, reference may be made to the following detailed description taken in conjunction with the accompanying drawings in which.

DETAILED DESCRIPTION OF THE INVENTION

An embodiment of the invention will now be described hereinbelow with reference to the noted drawings.

Figure 1:
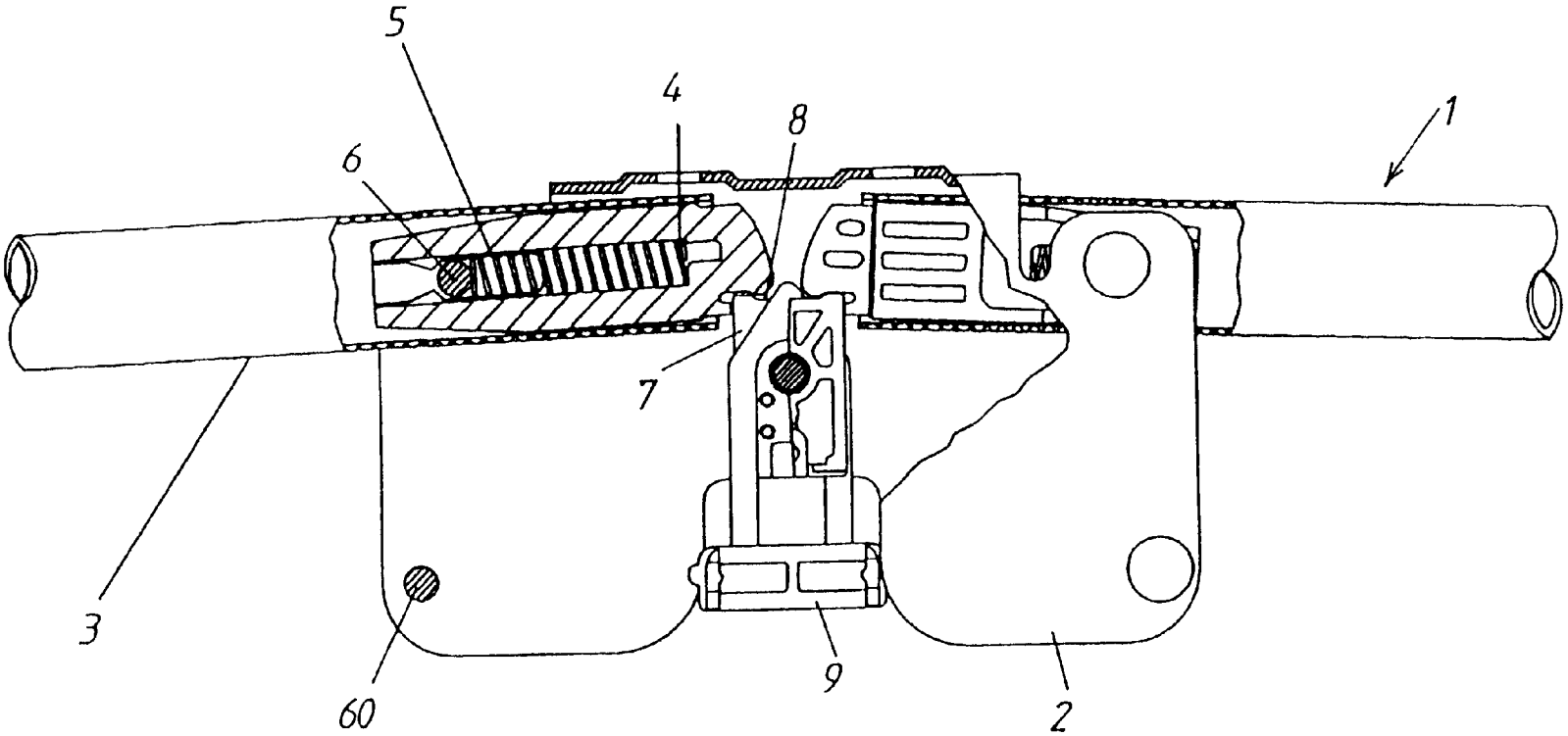
FIG. 1 is a side elevational partial cross sectional view of a prior art foldable mechanism.
Figure 2:
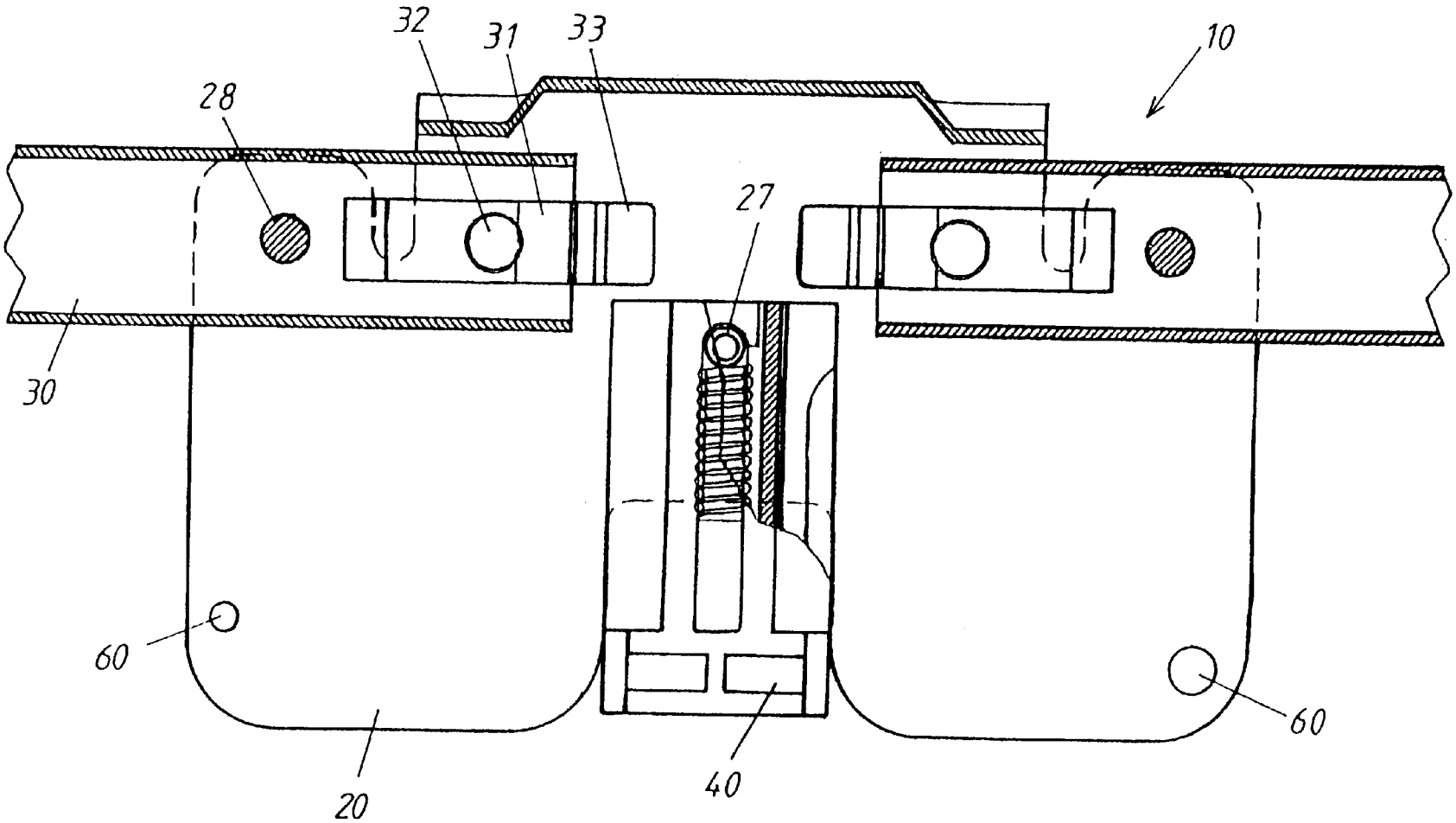
FIG. 2 is a side elevational partial cross sectional view of an exemplary foldable mechanism of the invention in the unfolded condition.
Figure 3:
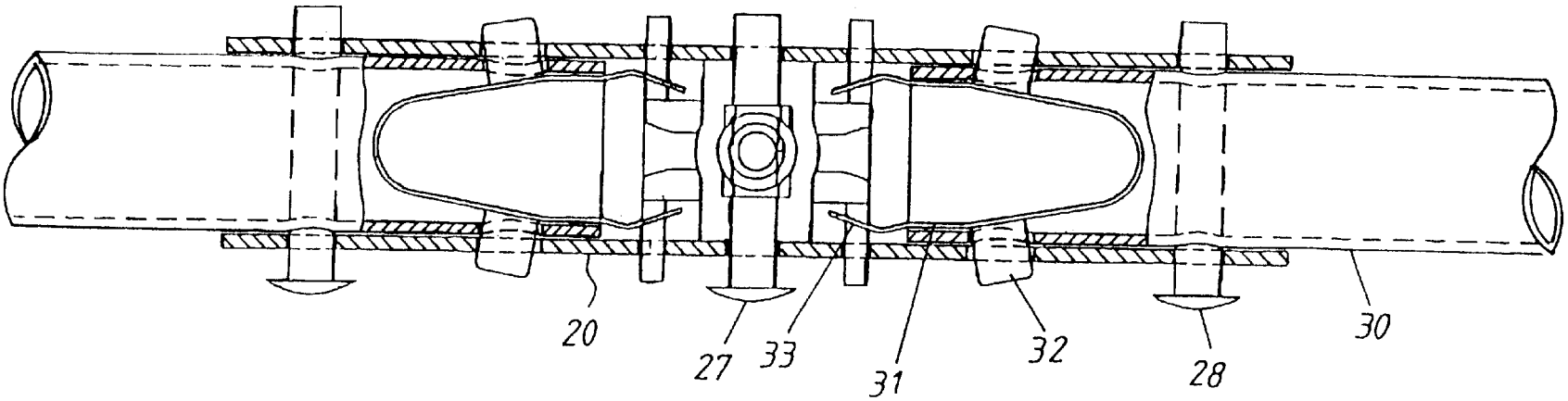
FIG. 3 is a top elevational partial cross sectional view of an exemplary foldable mechanism of the invention in the unfolded condition.

As shown in FIGS. 2 and 3, a foldable mechanism 10 for a playpen comprises a connection element 20, a pair of hollow rods 30, and a press-down block 40.

Figure 7:
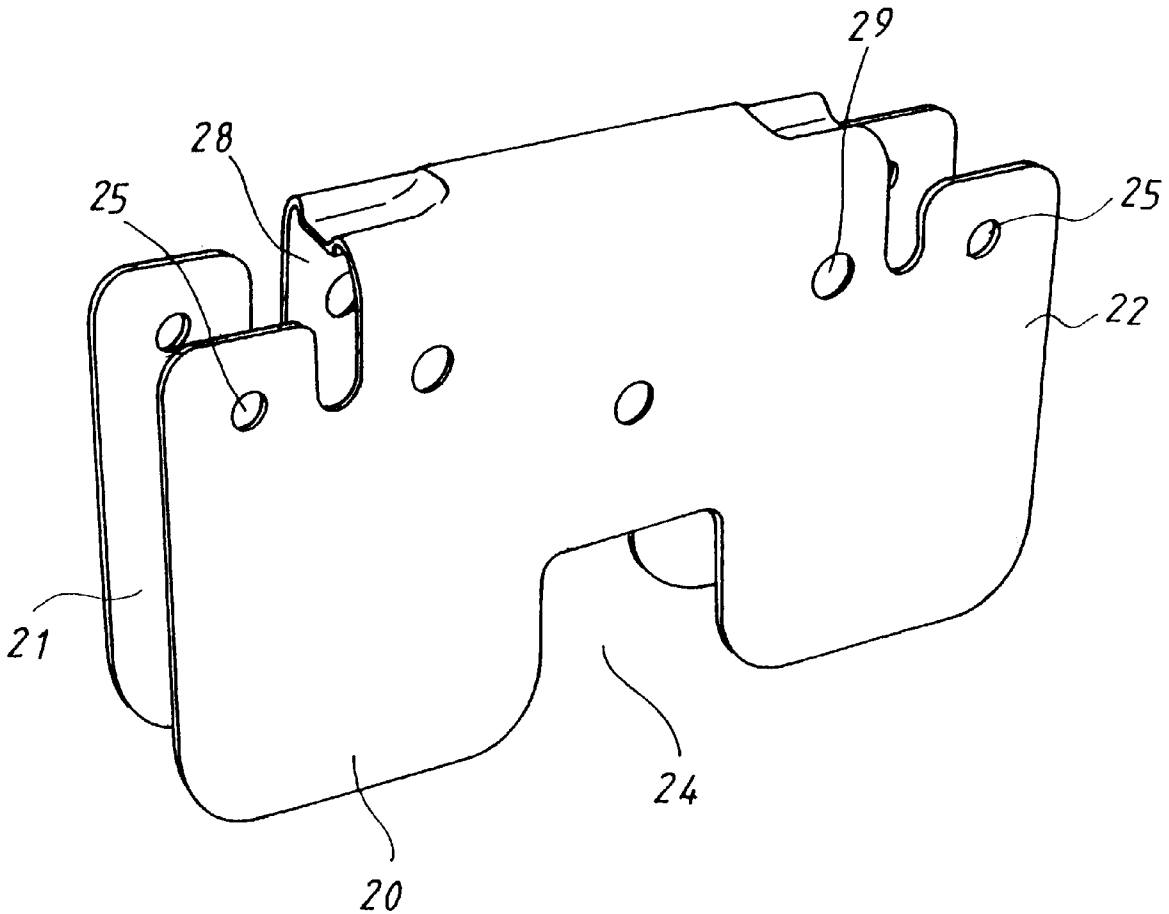
FIG. 7 is a perspective view of an exemplary connection element in accordance with the invention.

As shown in FIG. 7, the connection element 20 has a substantially U-shaped cross section and includes two open side faces 21, one front face 22, and one rear face 23. The front and rear faces 22, 23 have a U-shaped cutout 24 and a plurality of first openings 25 and a plurality of second openings 29. The U-shaped cutout 24 and the plurality of first openings 25 are provided for attaching the rods 30 and the pressed-down block 40, as shown in FIG. 2. The plurality of second openings 39 are provided for locking the rods 30 in the unfolded condition.

Figure 8:
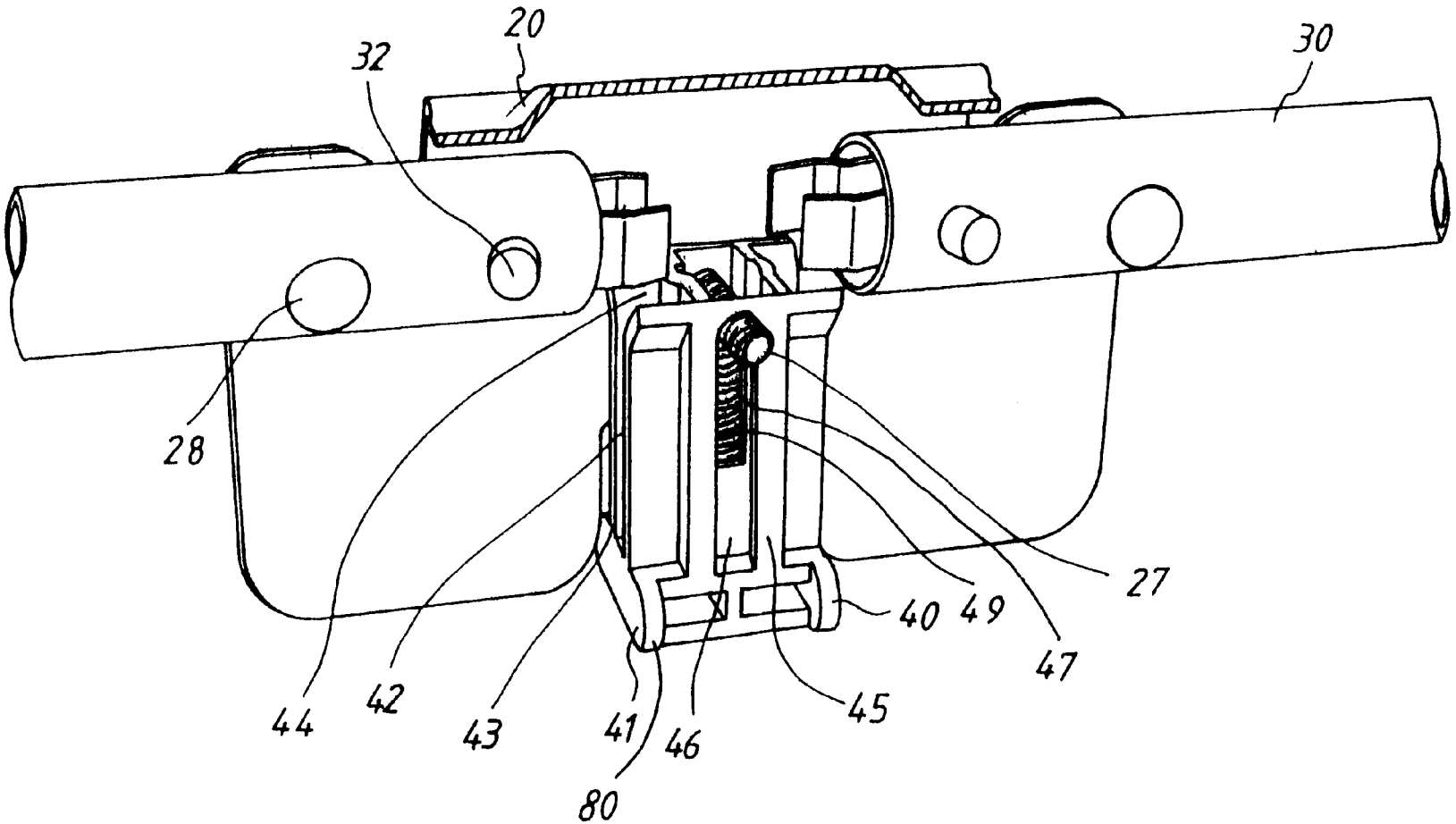
FIG. 8 is a perspective view of an exemplary foldable mechanism of the invention showing the press-down block.

As shown in FIG. 8, the press-down block 40 has a substantially a rectangular body having two sides 41, a front and rear face 45, and a hollow center 48 with one end closed for receiving a spring 49. The sides 41 each have a side groove 42 with a narrow portion 43 and an enlarged open end 44. The front and rear faces 45 each have a groove 46 with two closed ends, and an elongated through hole 47 passing through the front and rear faces 45.

As shown in FIG. 8, the press-down block 40 is attached to the connection element 20 by a first screw 27 passing through the through hole 47 and pressed against the spring 49. Because the first screw 27 is forced to move within the through hole 47, the press-down block 40 can be vertically pressed with respect to the connection element 20 by an external force and moved back by the spring force along the through hole 47.

As shown, in FIG. 2 and FIG. 3, each hollow rod 30 includes a U-shaped reed spring 31 with a duck bill 33 and two outer faces. The reed spring 31 includes a protrusion 32 on each outer face that extend through openings in the hollow rod 30 and through a second opening 29 in the connection element 20. Each hollow rod 30 is attached by a second screw 28 to the connection element 20, whereby the rods 30 may pivotally rotate with respect to the connection element 20.

In the unfolded condition, each hollow rod 30 is pivotally rotated to a horizontal orientation using the screw 28 as a fulcrum. The duck bill 33 of the reed spring 31 is slid along the narrow portion 43 of the side groove 42, and then the reed spring 31 expands and the protrusions 32 are engaged into second openings 29 provided on the front and rear faces 22, 23 of the connection element 20, when the duck bill 33 of the reed spring 31 enters into the enlarged open end 44. At this time, the rods 30 are horizontally oriented through the second screw 28 and the engagement of protrusions 32 with second openings 29, as shown in FIG. 3.

Figure 4:
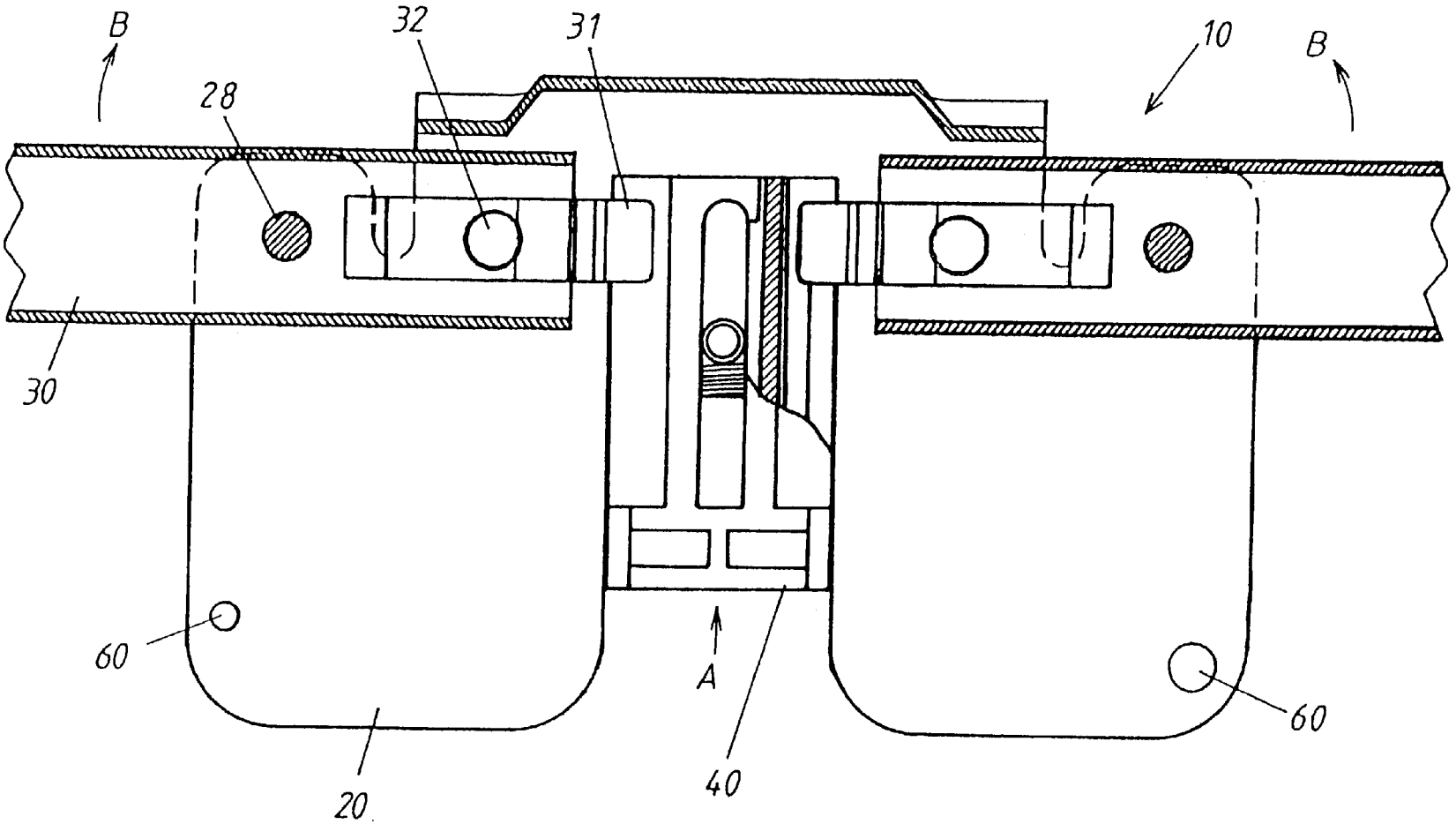
FIG. 4 is a side elevational partial cross sectional view of operation of a exemplary foldable mechanism of the invention, where the arrows present moving directions of a connection element and rods.
Figure 5:
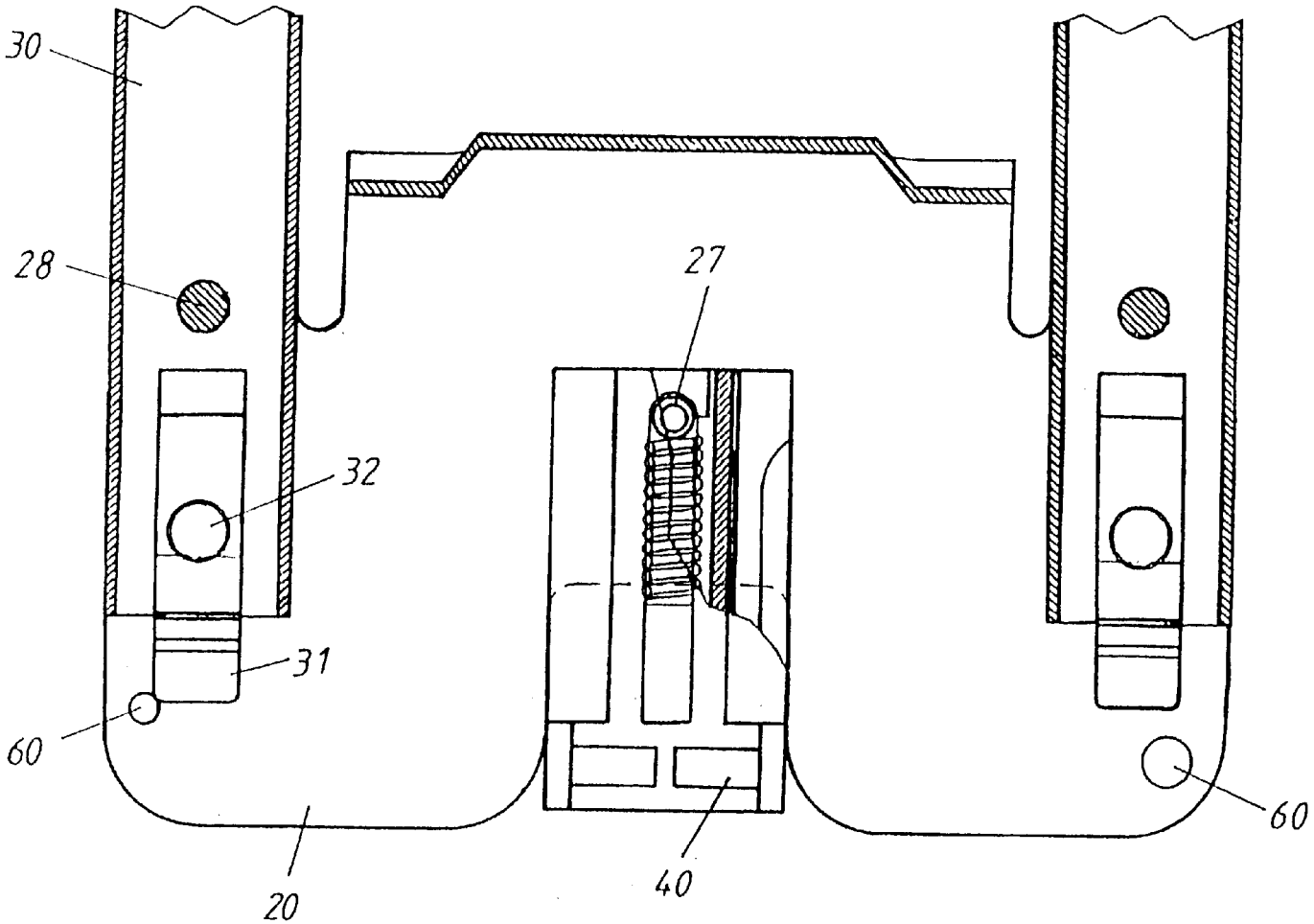
FIG. 5 is a side elevational partial cross sectional view of an exemplary foldable mechanism of the invention in the folded condition.
Figure 6:
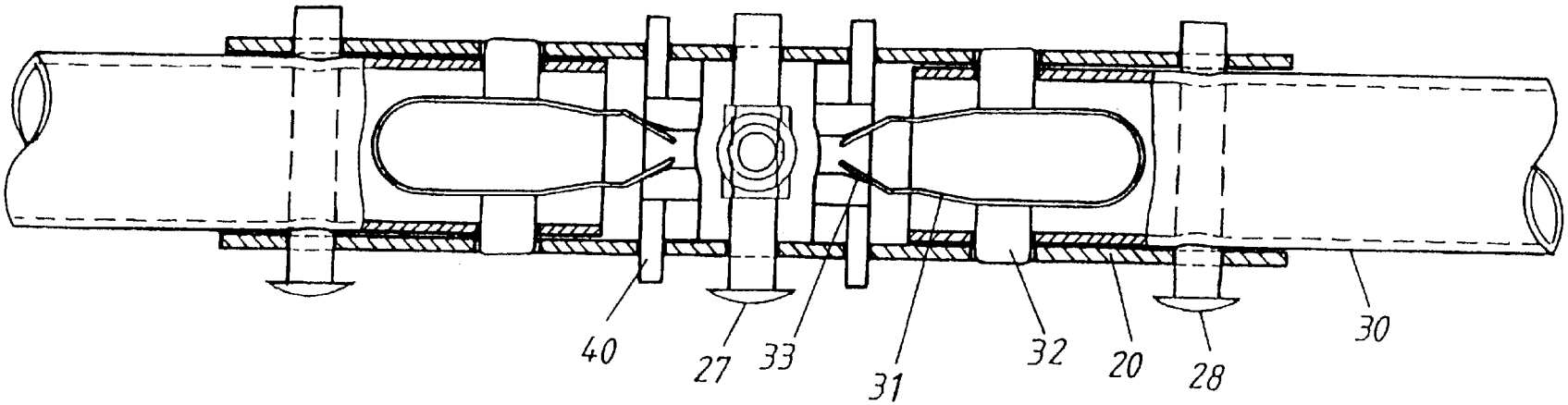
FIG. 6 is top elevational partial cross sectional view of an exemplary foldable mechanism of the invention in the folded condition.

In the folded condition, as shown in FIGS. 4–6, the press down block 40 is pressed down, or biased, by an external force as shown by arrow A (shown in FIG. 4). Then, the duck bill 33 of the reed spring 31 is guided and slid along the side groove 42 and pressed to exit the enlarged open end 44 and enter into the narrow portion 43 of the side groove 42. After the duck bill 33 of the reed spring 31 enters into the narrow portion 43 of the side groove 42, the reed spring 31 is compressed and the protrusions 32 are disengaged from the openings 29, such that the rods 30 may be pivotally rotated (in the arrow B shown in FIG. 4) to vertical orientation using the second screw 28 as a fulcrum.

In a preferred embodiment, the foldable mechanism 10 may further comprise a pair of screws 60 passing through openings provided on the front and rear faces 22, 23 of the connection element 20 so as to limit the rotation of the hollow rods 30, as shown in FIG. 5.

In a preferred embodiment, the press-down block 40 may further comprise protrusions 80 extending from the two sides 41 of the press-down block 40 for positioning the press-down block 40 in the cutout 24 of the connection element 20 without rotation, as shown in FIG. 8.

Although this invention has been described in its preferred embodiments, it is understood that the present disclosure of the preferred embodiment has been made only by way of example and numerous changes in the details of the construction and combination of arrangement of parts may be resorted to without departing from the spirit and scope of this invention.

What is claimed is:

1. A foldable mechanism for a playpen comprising:

a connection element having a substantially U shaped cross section with two open side faces, one front face, and one rear face, the front and rear faces being provided with a U-shaped cutout and a plurality of first openings and a plurality of second openings;

a press-down block having two sides each with a side groove having a narrow portion and an enlarged open end, front and rear faces each having a groove with two closed ends, an elongated through hole passing through the front and rear faces, and a hollow center with one closed end for receiving a spring, the press-down block being attached to the connection element by a first screw passing through the through hole and pressed against the spring, such that the press-down block can be biased by an external force and moved back by the spring force; and a pair of hollow rods each having therein a U-shaped reed spring comprising a duck bill, two outer faces, and a protrusion on each outer face of the reed spring, each rod being attached by a second screw to the connection element, whereby in the unfolded condition, each hollow rod is pivotally rotated to a horizontal orientation, the duck bill of the reed spring is slid along the narrow portion of the side groove and the reed spring expands and the protrusions are engaged into the second openings of the connection element after the duck bill of the reed spring enters into the enlarged open end, and in the folded condition, the connection element is biased so that the duck bill of the reed spring exits the enlarged open end and enters into the narrow portion of the side groove, the reed spring is compressed, the protrusions are disengaged from the second openings, and the rods are oriented vertically.

2. The foldable mechanism of claim 1, further comprising a pair of screws passing through openings provided on the front and rear faces of the connection element so as to limit the rotation of the hollow rods.

3. The foldable mechanism of claim 1, wherein the press-down block further comprises protrusions extending from the two sides of the press-down block for positioning the press-down block in the cutout of the connection element without rotation.

* * * * *